US006837196B2

(12) United States Patent
Sun

(10) Patent No.: US 6,837,196 B2
(45) Date of Patent: Jan. 4, 2005

(54) ENGINE VALVE ACTUATOR ASSEMBLY WITH AUTOMATIC REGULATION

(75) Inventor: Zongxuan Sun, Troy, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/405,994

(22) Filed: Apr. 2, 2003

(65) Prior Publication Data

US 2004/0194742 A1 Oct. 7, 2004

(51) Int. Cl.[7] ..... F01L 9/02
(52) U.S. Cl. ..... 123/90.12; 123/90.15
(58) Field of Search ..... 123/90.12, 90.15, 123/90.16, 90.17, 90.18

(56) References Cited

U.S. PATENT DOCUMENTS

| | | | | |
|---|---|---|---|---|
| 1,703,858 A | | 3/1929 | Banner | |
| 3,157,166 A | | 11/1964 | MacNeill | |
| 4,009,695 A | * | 3/1977 | Ule | 123/90.13 |
| 4,044,652 A | | 8/1977 | Lewis et al. | |
| 4,459,946 A | | 7/1984 | Burandt | |
| 4,807,517 A | | 2/1989 | Daeschner | |
| 5,373,818 A | | 12/1994 | Unger | |
| 5,421,545 A | | 6/1995 | Schexnayder | |
| 5,546,222 A | | 8/1996 | Plaessmann et al. | |
| 5,572,961 A | | 11/1996 | Schechter et al. | |
| 5,638,781 A | | 6/1997 | Sturman | |
| 5,881,689 A | | 3/1999 | Hochholzer | |
| 6,109,284 A | | 8/2000 | Johnson et al. | |
| 6,112,711 A | | 9/2000 | Shimizu et al. | |
| 6,263,842 B1 | | 7/2001 | DeOjeda et al. | |
| 6,374,784 B1 | | 4/2002 | Tischer et al. | |
| 6,505,584 B2 | | 1/2003 | Lou | |
| 6,688,267 B1 | | 2/2004 | Raghavan | |
| 2003/0015155 A1 | * | 1/2003 | Turner et al. | 123/90.12 |
| 2003/0172885 A1 | * | 9/2003 | Gaessler et al. | 123/90.14 |

* cited by examiner

*Primary Examiner*—Thomas Denion
*Assistant Examiner*—Jaime Corrigan
(74) *Attorney, Agent, or Firm*—Kathryn A. Marra

(57) ABSTRACT

A valve actuator assembly for an engine includes a movable engine valve, a movable first spool valve, and a movable second spool valve. The valve actuator assembly also includes a driving channel interconnecting the second spool valve and the engine valve, an intermediate channel interconnecting the first spool valve and the second spool valve, and a feedback channel interconnecting the second spool valve and the engine valve. The valve actuator assembly includes an actuator operatively cooperating with the first spool valve to position the first spool valve to prevent and allow fluid flow in and out of the second spool valve and the driving channel to position the engine valve. The valve actuator assembly further includes an on/off valve in fluid communication with the feedback channel to enable and disable the feedback channel to control motion of the second spool valve.

20 Claims, 2 Drawing Sheets

ENGINE VALVE ACTUATOR ASSEMBLY WITH AUTOMATIC REGULATION

TECHNICAL FIELD

The present invention relates generally to intake or exhaust valve actuators for engines and, more particularly, to a valve actuator assembly with automatic regulation for an internal combustion engine.

BACKGROUND OF THE INVENTION

It is known to provide a valve train or valve actuator assembly for an engine such as an internal combustion engine of a vehicle such as a motor vehicle. Typically, the valve train includes one or more valves, a cam shaft having at one or more cams, and a tappet contacting each cam and valve. Typically, engine valve actuation is accomplished via the engine-driven camshaft. However, this type of valve actuation introduces constraints on valve operation that preclude optimal valve opening and closing schedules, compromising engine performance, fuel economy, and emissions.

It is also known to provide a camless valve train for an internal combustion engine. An example of such a camless valve train is disclosed in the prior art. For example, a camless intake/exhaust valve for an internal combustion engine is controlled by a solenoid actuated fluid control valve. The control valve has a pair of solenoids that move a spool. The solenoids are digitally latched by short digital pulses provided by a microcontroller.

One disadvantage of some camless valve trains is their poor controllability due to open loop instability, which causes great difficulty in their operation. Another disadvantage of some camless valve trains is that they do not provide full capability for variable lift. Further disadvantages of some camless valve trains are that they have relatively high cost, large size, high energy consumption, low repeatability from cycle to cycle and cylinder to cylinder, hard seating impact, and high seating velocity induced noise.

As a result, it is desirable to provide a valve actuator assembly for an engine that improves controllability. It is also desirable to provide a valve actuator assembly for an engine having more flexibility and full capacity for variable lift. It is further desirable to provide a valve actuator assembly for an engine that reduces energy consumption and provides satisfactory seating velocity. Therefore, there is a need in the art to provide a valve actuator assembly for an engine that meets these desires.

SUMMARY OF THE INVENTION

It is, therefore, one object of the present invention to provide a new camless valve actuator assembly for an engine.

It is another object of the present invention to provide a valve actuator assembly for an engine that has automatic regulation for controllability.

To achieve the foregoing objects, the present invention is a valve actuator assembly for an engine. The valve actuator assembly includes a movable engine valve, a movable first spool valve, and a movable second spool valve. The valve actuator assembly also includes a driving channel interconnecting the second spool valve and the engine valve, an intermediate channel interconnecting the first spool valve and the second spool valve, and a feedback channel interconnecting the second spool valve and the engine valve. The valve actuator assembly includes an actuator operatively cooperating with the first spool valve to position the first spool valve to prevent and allow fluid flow in and out of the second spool valve and the driving channel to position the engine valve. The valve actuator assembly further includes an on/off valve in fluid communication with the feedback channel to enable and disable the feedback channel to control motion of the second spool valve.

One advantage of the present invention is that a valve actuator assembly is provided for an engine that has hydraulic feedback for precise motion by self-regulating flow control. Another advantage of the present invention is that the valve actuator assembly has controllability that is open loop stable with automatic regulation. Yet another advantage of the present invention is that the valve actuator assembly is an enabler for improved valve train stability without sacrificing dynamic performance. Still another advantage of the present invention is that the valve actuator assembly is an enabler for improved engine performance, improved engine fuel economy by lowering fuel consumption and improved engine emissions by lowering emissions. A further advantage of the present invention is that the valve actuator assembly minimizes energy consumption by self-regulation flow control, simple spool valves, and efficient valve control to minimize throttling of the fluid flow. Yet a further advantage of the present invention is that the valve actuator assembly has uses one solenoid, one on/off valve, and two spool valves. Still a further advantage of the present invention is that the valve actuator assembly has a relatively small size and is easy to package in an engine. Another advantage of the present invention is that the valve actuator assembly has a relatively low cost. Yet another advantage of the present invention is that the valve actuator assembly has improved output torque and built-in soft landing capability to reduce noise and improve durability. A further advantage of the present invention is that the valve actuator assembly has independent control over the first and second spool valves for improved dynamic response.

Other objects, features, and advantages of the present invention will be readily appreciated, as the same becomes better understood, after reading the subsequent description taken in conjunction with the accompanying drawings.

DESCRIPTION OF THE PREFERRED EMBODIMENT

Figure 1:
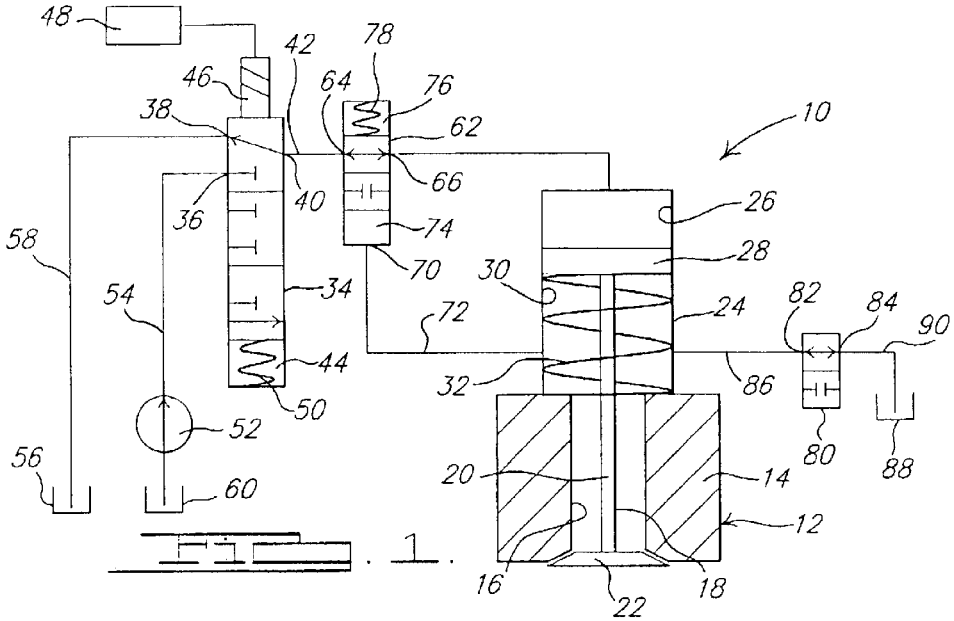
FIG. 1 is a diagrammatic view of a valve actuator assembly, according to the present invention, illustrated in operational relationship with an engine of a vehicle.
Figure 2:
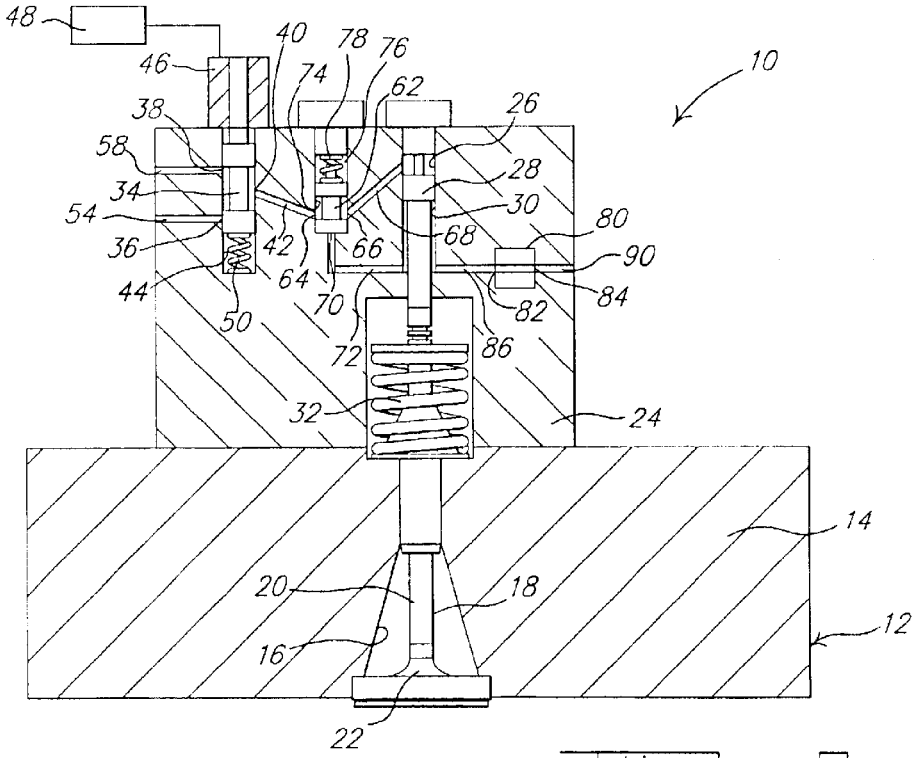
FIG. 2 is a fragmentary view of the valve actuator assembly of FIG. 1 in an engine valve closed position.
Figure 3:
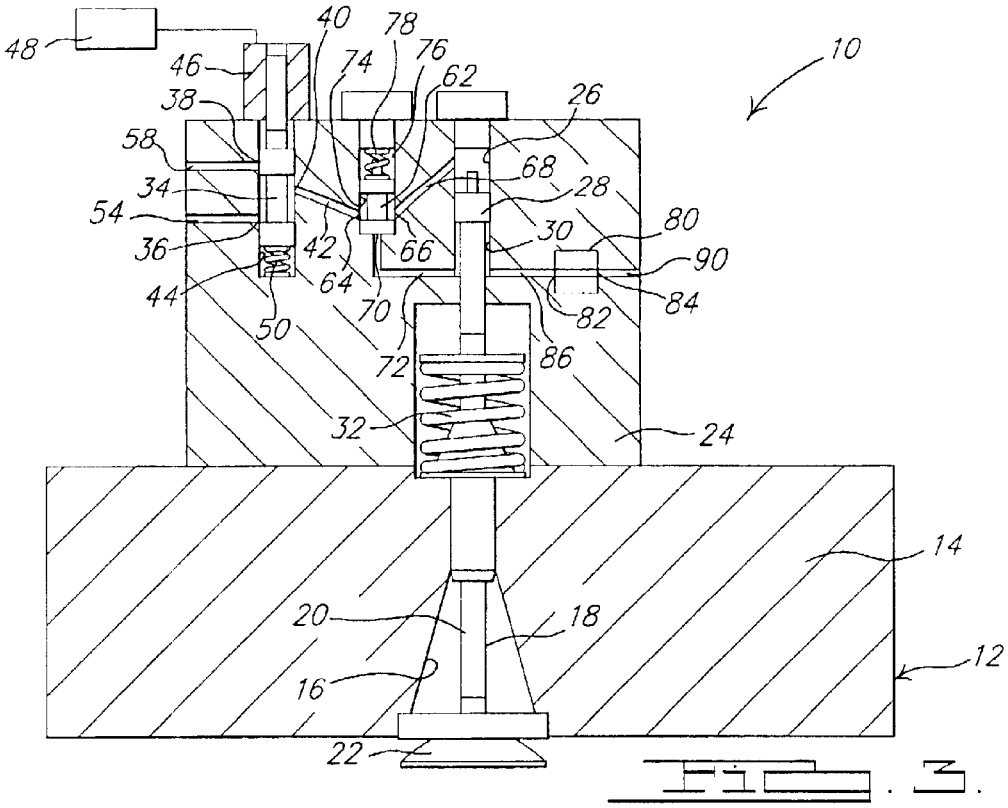
FIG. 3 is a view similar to FIG. 2 illustrating the valve actuator assembly in an engine valve part opened position.
Figure 4:
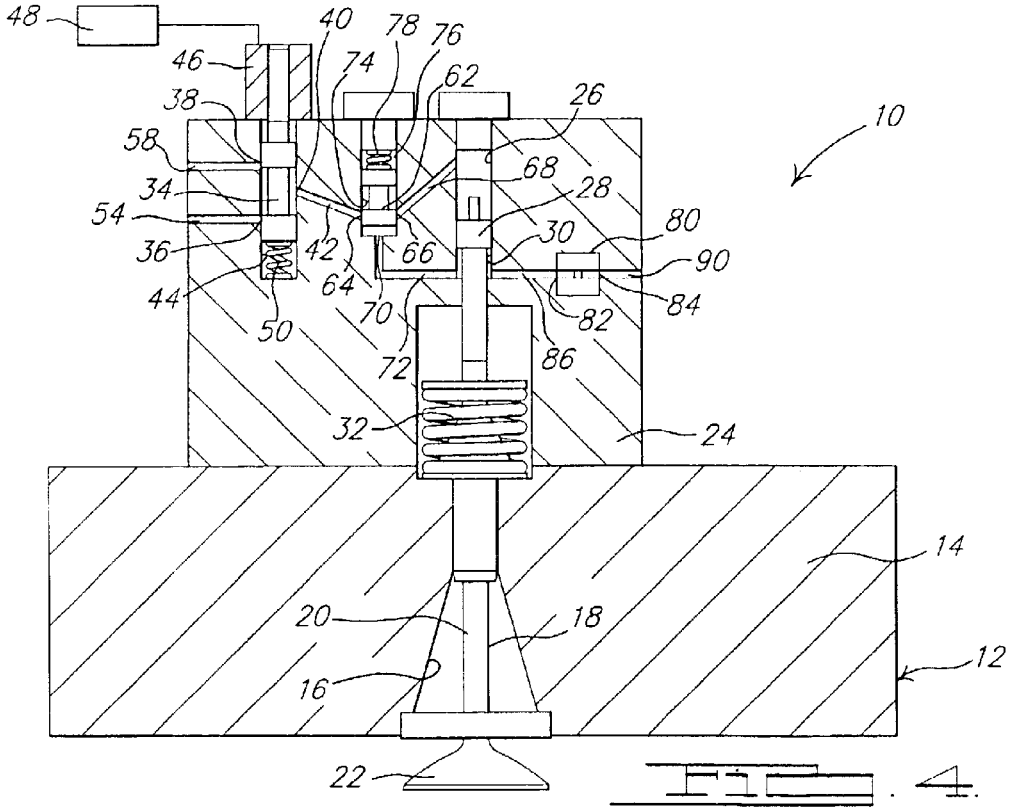
FIG. 4 is a view similar to FIG. 2 illustrating the valve actuator assembly in an engine valve fully opened position.

Referring to the drawings and in particular FIG. 1, one embodiment of a valve actuator assembly 10, according to the present invention, is shown for an engine, generally indicated at 12, of a vehicle (not shown). The engine 12 is of an internal combustion type. The engine 12 includes an engine block 14 having at least one opening 16 therein in communication with at least one internal combustion chamber (not shown). The engine 12 also includes a movable engine valve 18 for each opening 16. The engine valve 18 has a valve stem 20 and a valve head 22 at one end of the valve stem 20. The engine valve 18 is movable to open and close its respective opening 16 between an open position as illustrated in FIGS. 3 and 4 and a closed position as illustrated in FIG. 2. It should be appreciated that the engine valve 18 may be either an intake or exhaust valve. It should also be appreciated that the valve actuator assembly 10 is a camless valve train for the engine 12. It should further be appreciated that, except for the valve actuator assembly 10, the engine 12 is conventional and known in the art.

The valve actuator assembly 10 includes a valve housing 24 disposed adjacent the engine block 14. The valve housing 24 has a main or primary fluid chamber 26 therein. The valve actuator assembly 10 also includes a piston 28 connected to or in contact with the engine valve 18 at the end of the valve stem 20 opposite the valve head 22. The piston 28 is disposed in the primary fluid chamber 26 of the valve housing 24 and forms a secondary fluid chamber 30 therein. The valve actuator assembly 10 includes an engine valve spring 32 disposed about the valve stem 20 and contacting the engine block 14 to bias the engine valve 18 toward the closed position of FIG. 2. It should be appreciated that the valve head 22 closes the opening 16 when the engine valve 18 is in the closed position.

The valve actuator assembly 10 also includes a first spool valve 34 fluidly connected to the primary fluid chamber 26 of the valve housing 24. The first spool valve 34 is of a three-position three-way type. The first spool valve 34 has a high pressure port 36 and a low pressure port 38. The first spool valve 34 also has a primary fluid chamber port 40 fluidly connected by an intermediate channel 42 to a second spool valve to be described. The first spool valve 34 also has a chamber 44 at one end thereof. It should be appreciated that the first spool valve 34 controls fluid flow to the second spool valve.

The valve actuator assembly 10 includes an actuator 46 at one end of the first spool valve 34 opposite the chamber 44. The actuator 46 is of a linear type such as a solenoid electrically connected to a source of electrical power such as a controller 48. The valve actuator assembly 10 further includes a first spool valve spring 50 disposed in the chamber 44 to bias the first spool valve 34 toward the actuator 46. It should be appreciated that the actuator 50 may be any suitable device that generates straight-line motion. It should also be appreciated that the controller 48 energizes and de-energizes the actuator 46 to move the first spool valve 34.

The valve actuator assembly 10 also includes a fluid pump 52 and a high pressure line 54 fluidly connected to the fluid pump 52 and the high pressure port 36. The valve actuator assembly 10 includes a fluid tank 56 and a low pressure line 58 fluidly connected to the fluid tank 56 and the low pressure port 38. It should be appreciated that the fluid pump 52 may be fluidly connected to the fluid tank 56 or a separate fluid tank 60.

The valve actuator assembly 10 also includes a second spool valve 62 fluidly connected to the primary fluid chamber 26 of the valve housing 24 and the first spool valve 34. The second spool valve 62 is of a two-position two-way type. The second spool valve 62 has a first port 64 fluidly connected by the intermediate channel 42 to the first spool valve 34 and a second port 66 fluidly connected by a driving channel 68 to the primary fluid chamber 26. The second spool valve 62 also has a third port 70 fluidly connected by a feedback channel 72 to the secondary fluid chamber 30. The second spool valve 62 also has a third or tertiary fluid chamber 74 at one end thereof fluidly connected to the third port 70. It should be appreciated that the second spool valve 62 controls fluid flow with the primary fluid chamber 26.

The valve actuator assembly 10 includes a chamber 76 at one end of the second spool valve 62 opposite the fluid chamber 74. The valve actuator assembly 10 further includes a second spool valve spring 78 disposed in the chamber 76 to bias the second spool valve 62 toward the fluid chamber 74. It should be appreciated that fluid pressure in the fluid chamber 74 that overcomes the force of the second spool valve spring 78 moves the second spool valve 62.

The valve actuator assembly 10 further includes an on/off valve 80 fluidly connected to the secondary fluid chamber 30 of the valve housing 24. The on/off valve 80 is of a two-way magnetically latchable type and is electrically connected to a source of electrical power such as the controller 48. The on/off valve 80 has a first port 82 and a second port 84. The first port 82 is fluidly connected by a channel 86 to the secondary fluid chamber 30. The valve actuator assembly 10 includes a fluid tank 88 fluidly connected to the second port 84 by a low pressure line 90. It should be appreciated that the fluid tank 88 is a low pressure source.

In operation of the valve actuator assembly 10, the engine valve 18 is shown in a closed position as illustrated in FIG. 2. At the closed position of the engine valve 18, the actuator 46 is de-energized by the controller 48 so that the first spool valve spring 50 pushes the first spool valve 34 upward and exposes the intermediate channel 42 to the low pressure line 58. The on/off valve 80 is open so that both the secondary fluid chamber 30 and the tertiary fluid chamber 74 are exposed to the fluid tank 88. The second spool valve spring 78 pushes the second spool valve 62 downward so that the primary fluid chamber 26 is then connected to the low pressure line 58 through the driving channel 68 and the intermediate channel 42. The engine valve spring 32 keeps the engine valve 18 closed with the valve head 22 closing the opening 16.

To open the engine valve 18, the controller 48 energizes the actuator 46 and causes the actuator 46 to overcome the force of the first spool valve spring 50 and drive the first spool valve 34 downward. The intermediate channel 42 is then exposed to the high pressure line 54. The on/off valve 80 is open so that the secondary fluid chamber 30 and the tertiary fluid chamber 74 are exposed to the fluid tank 88. The high pressure fluid flows into the primary fluid chamber 26 through the driving channel 68, which overcomes the force from the engine valve spring 32 and pushes the engine valve 18 open as illustrated in FIG. 3. It should be appreciated that, in FIG. 3, the engine valve 18 is illustrated in a valve part open position.

To stop the engine valve 18 at a predetermined lift position, the controller 48 energizes the on/off valve 80 and the on/off valve 80 is closed, cutting off the fluid connection between the secondary fluid chamber 30 and the fluid tank 88. As the engine valve 18 continues to move downward, the piston 28 pushes the fluid in the secondary fluid chamber 30 via the feedback channel 72 into the tertiary fluid chamber 74, which drives the second spool valve 62 upward. This motion continues until the second spool valve 62 cuts off the fluid connection between the driving channel 68 and the intermediate channel 42 and reaches its mechanical stop. When the second spool valve 62 reaches this equilibrium point, the engine valve 18 stops as illustrated in FIG. 4. It should be appreciated that, in FIG. 4, the engine valve 18 is illustrated in a valve open position.

To close the engine valve 18, the controller 48 de-energizes the actuator 46. The first spool valve spring 50 then pushes the first spool valve 34 upward and exposes the intermediate channel 42 to the low pressure line 58. The on/off valve 80 is de-energized so that the tertiary fluid chamber 74 and the second fluid chamber 30 are connected to the low pressure fluid tank 88. The second spool spring 78 pushes the second spool 62 downward so that the driving channel 68 is connected to the intermediate channel 42. The high pressure fluid in the primary fluid chamber 26 will exhaust into the low pressure line 58 and return to the fluid tank 56 through the driving channel 68 and the intermediate channel 42. The engine valve spring 32 drives the engine valve 18 back such that the valve head 22 closes the opening 16 as illustrated in FIG. 2. It should be appreciated that the spool valve spring 50 may be eliminated and the actuator 46 may be of a push/pull type to connect the intermediate channel 42 to the low pressure line 58.

The valve actuator assembly 10 of the present invention is made open-loop stable by utilizing the hydraulic feedback channel 72 and the on/off valve 80 is used to enable or disable the feedback channel 72. Open-loop stability implies that a system's response to a given input signal is not unbounded. The better controllability achieved by open loop stability enables the valve actuator assembly 10 to provide better performance and energy consumption. The valve actuator assembly 10 of the present invention precisely controls the motion of the second spool valve 62 through the feedback channel 72 so that it avoids unnecessary throttling of the low pressure flow and high pressure flow, thereby providing energy consumption benefit. It should be appreciated that the tertiary fluid chamber 74 and the feedback channel 72 can also be located on top of the second spool valve 62 so that soft seating of the valve head 22 of the engine valve 18 can be achieved by hydraulic feedback.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A valve actuator assembly for an engine of a vehicle comprising:

a movable engine valve;

an engine valve spring disposed about said engine valve to bias said engine valve toward a closed position;

a movable first spool valve;

a movable second spool valve;

a driving channel interconnecting said second spool valve and said engine valve;

an intermediate channel interconnecting said first spool valve and said second spool valve;

a feedback channel interconnecting said second spool valve and said engine valve;

an actuator operatively cooperating with said first spool valve to position said first spool valve to prevent and allow fluid flow in and out of said second spool valve and said driving channel to position said engine valve between an open position and the closed position; and an on/off valve in fluid communication with said feedback channel to enable and disable said feedback channel to control motion of said second spool valve.

2. A valve actuator assembly as set forth in claim 1 including a valve housing.

3. A valve actuator assembly as set forth in claim 2 wherein said valve housing has a first fluid chamber fluidly communicating with said driving channel and a second fluid chamber fluidly communicating with said feedback channel.

4. A valve actuator assembly as set forth in claim 3 including a piston operatively cooperating with said engine valve and being disposed in said valve housing and having said first fluid chamber on one side and said second fluid chamber on an opposite side.

5. A valve actuator assembly as set forth in claim 3 including an on/off valve channel interconnecting said second fluid chamber and said on/off valve.

6. A valve actuator assembly as set forth in claim 1 including a low pressure fluid line connected to said first spool valve.

7. A valve actuator assembly as set forth in claim 1 including a high pressure fluid line connected to said first spool valve.

8. A valve actuator assembly as set forth in claim 1 including a third fluid chamber at one end of said second spool valve and fluidly communicating with said feedback channel.

9. A valve actuator assembly as set forth in claim 8 including a first spool valve spring to bias said first spool valve toward said actuator.

10. A valve actuator assembly as set forth in claim 9 including a second spool valve spring to bias said second spool valve toward said third fluid chamber.

11. A valve actuator assembly as set forth in claim 1 wherein said actuator is of a linear type to generate linear motion.

12. A valve actuator assembly as set forth in claim 11 including a controller electrically connected to said actuator to energize and de-energize said actuator.

13. A valve actuator assembly comprising:

a movable engine valve;

an engine valve spring disposed about said engine valve to bias said engine valve toward a closed position:

a movable first spool valve;

a movable second spool valve;

a valve housing having a first fluid chamber and a second fluid chamber;

a piston operatively cooperating with said engine valve and being disposed in said valve housing and having said first fluid chamber on one side and said second fluid chamber on an opposite side;

a driving channel interconnecting said second spool valve and said first fluid chamber;

an intermediate channel interconnecting said second spool valve and said first spool valve;

a feedback channel interconnecting said second spool valve and said second fluid chamber;

an actuator operatively cooperating with said first spool valve to position said first spool valve to prevent and allow fluid flow in and out of said second spool valve and said driving channel to position said engine valve between an open position and the closed position; and an on/off valve in fluid communication with said feedback channel to enable and disable said feedback channel to stop said engine valve at a predetermined lift position.

14. A valve actuator assembly as set forth in claim 13 including an on/off valve channel interconnecting said secondary fluid chamber and said on/off valve.

15. A valve actuator assembly as set forth in claim 13 including a third fluid chamber at one end of said second spool valve and fluidly communicating with said feedback channel.

16. A valve actuator assembly as set forth in claim 15 including a second spool valve spring to bias said second spool valve toward said third fluid chamber.

17. A valve actuator assembly as set forth in claim 13 including a first spool valve spring to bias said first spool valve toward said actuator.

18. A valve actuator assembly as set forth in claim 13 wherein said actuator is of a linear type to generate linear motion.

19. A valve actuator assembly as set forth in claim 18 including a controller electrically connected to said actuator to energize and de-energize said actuator.

20. A method of operating a valve actuator assembly for a vehicle comprising:

providing a movable engine valve;

providing an engine valve spring disposed about the engine valve and biasing the engine valve toward a closed position;

providing a first movable spool valve;

providing a second movable spool valve;

actuating an actuator operatively cooperating with the first spool valve and supplying an intermediate channel interconnecting the first spool valve and the second spool valve and a driving channel interconnecting the second spool valve and the engine valve with high pressure fluid to move the engine valve to an open position;

supplying a feedback channel interconnecting the second spool valve and the engine valve with fluid flow; and enabling and disenabling the feedback channel via an on/off valve and controlling motion of the second spool valve.

* * * * *